US009756970B2

(12) United States Patent
Born et al.

(10) Patent No.: US 9,756,970 B2
(45) Date of Patent: Sep. 12, 2017

(54) TIP-RESISTANT CUP WITH HANDLE

(71) Applicants: Lily Ann Born, Skokie, IL (US); Joseph Born, Lincolnwood, IL (US)

(72) Inventors: Lily Ann Born, Skokie, IL (US); Joseph Born, Lincolnwood, IL (US)

( * ) Notice: Subject to any disclaimer, the term of this patent is extended or adjusted under 35 U.S.C. 154(b) by 0 days.

(21) Appl. No.: 14/682,556

(22) Filed: Apr. 9, 2015

(65) Prior Publication Data

US 2015/0327703 A1 Nov. 19, 2015

Related U.S. Application Data

(63) Continuation of application No. 14/039,530, filed on Sep. 27, 2013, now abandoned.

(60) Provisional application No. 61/706,931, filed on Sep. 28, 2012.

(51) Int. Cl.

| | |
|---|---|
| ***B65D 25/24*** | (2006.01) |
| ***A47G 19/22*** | (2006.01) |
| ***B65D 21/02*** | (2006.01) |
| ***A47G 19/23*** | (2006.01) |

(52) U.S. Cl.

CPC ..... *A47G 19/2261* (2013.01); *A47G 19/23* (2013.01); *B65D 21/0215* (2013.01)

(58) Field of Classification Search

CPC ..... A47G 19/22; A47G 19/2205; A47G 19/2261; A47G 19/23; B65D 21/00; B65D 21/02; B65D 21/0209; B65D 21/0215

USPC ..... 206/604, 628, 635, 636, 605, 633, 515, 206/516, 519, 520; D7/509, 510, 533, D7/534, 543, 558

See application file for complete search history.

(56) References Cited

U.S. PATENT DOCUMENTS

| | | | | | |
|---|---|---|---|---|---|
| D168,409 | S | * | 12/1952 | Kell | D7/524 |
| 2,803,375 | A | * | 8/1957 | Meshberg | A47G 19/23 16/110.1 |
| D329,355 | S | | 9/1992 | Yagi | D7/511 |
| D418,016 | S | * | 12/1999 | Varlet | D7/533 |
| D619,851 | S | * | 7/2010 | Miller | D24/197 |
| D646,524 | S | | 10/2011 | Kortleven | D7/533 |

* cited by examiner

*Primary Examiner* — Steven A Reynolds
*Assistant Examiner* — Javier A Pagan
(74) *Attorney, Agent, or Firm* — Clifford H. Kraft

(57) ABSTRACT

A tip-resistant cup with handle having at least three external extended legs that prevent tip-overs. The external legs extend down to the surface the cup being placed on to provide support from three different directions. In addition, any of the legs can be used has a handle. Cups of the present invention can be stacked like other cups by simply rotating the position of the legs. The cup of the present invention can also have a curved lip to further prevent spilling when the user is drinking.

11 Claims, 6 Drawing Sheets

TIP-RESISTANT CUP WITH HANDLE

This application is a continuation of application Ser. No. 14/039,530 filed Sep. 27, 2013 which is related to and claims priority from U.S. Provisional Patent Application No. 61/706,931 filed Sep. 28, 2012. Application Ser. No. 14/039,530 and 61/706,931 are hereby incorporated in their entirety.

FIELD OF THE INVENTION

The present invention relates generally to the field of cups and more particularly to a cup with handle that cannot easily be tipped over.

DESCRIPTION OF THE PROBLEM

A typical cup is very easy to knock over. Patients suffering from Parkinson's disease, Alzheimer's disease and other disorders especially find it very difficult to use a regular cup and many times tip it over while trying to drink. A typical cup with handle has a high center of gravity and is easily tipped.

Cups with wide bases and narrow tops are known in the art as attempts to partially solve this problem. While these cups work fairly well for healthy people, they are also easily tipped over by people with Parkinson's disease. Also, they slosh and spill some liquid if bumped or pushed. Other cups have been made with quite heavy weights in their bottoms. While these are hard to tip over, they are also heavy to lift and uncomfortable to drink from.

It would be very advantageous to have a cup that was almost impossible to tip over by brushing, pushing, touching, placing down on a bottom edge instead of the flat bottom and any other way a cup may tip over. It would also be advantageous if the cup had a modern, stylish look.

SUMMARY OF THE INVENTION

The present invention relates to a tip-resistant cup that has three external extended legs that prevent tip-overs. While three is the preferred number of legs, more that three can be used. The external legs extend down to approximately the surface the cup being placed on to provide support from three different directions. In addition, any of the legs can be used has a handle. Cups of the present invention can be stacked like other cups by simply rotating the position of the legs. The cup of the present invention can also have a curved lip to further prevent spilling when the user is drinking.

DESCRIPTION OF THE FIGURES

Several drawings illustrate features of the present invention.

Several drawings and illustrations have been presented to aid in understanding the present invention. The scope of the present invention is not limited to what is shown in the figures.

DESCRIPTION OF THE PREFERRED EMBODIMENT

Figure 1:
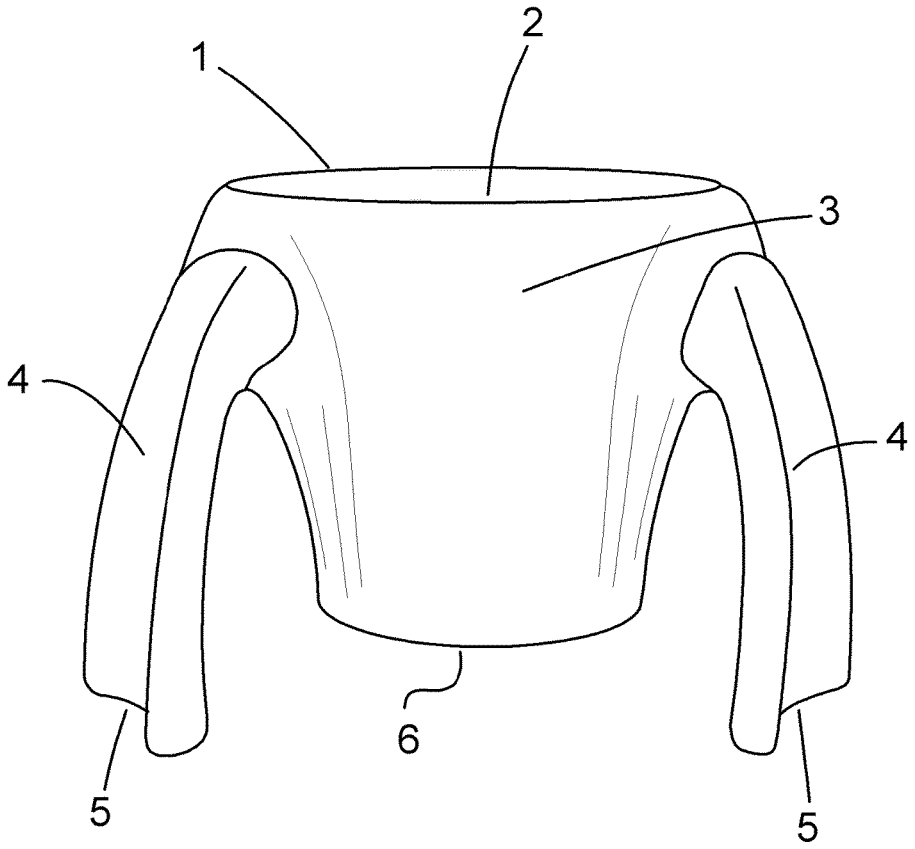
FIG. 1 shows a side view of an embodiment of the cup of the present invention.

The present invention relates to a tip-proof and spill-proof cup that is equipped with several legs to prevent tip-over and a curved lip to further prevent spilling. The preferred embodiment has three legs spaced evenly around the cup that extend downward to beyond the level of the cup bottom, thereby lifting the cup bottom from the resting surface. This is shown in FIG. 1. Alternatively, the legs can extend downward to a point equal to the cup bottom. The body has a base, a curved upper lip and three legs. The cup of FIG. 1 can be made from porcelain or any other solid material. Because of the support of the legs, it is extremely difficult to cause the cup to tip over. Rather, if brushed or pushed, the cup has a tendency to slide sideways. The curved lip prevents liquid from splashing out of the cup in this case and when someone is holding the cup at an angle rather than upright.

Figure 2:
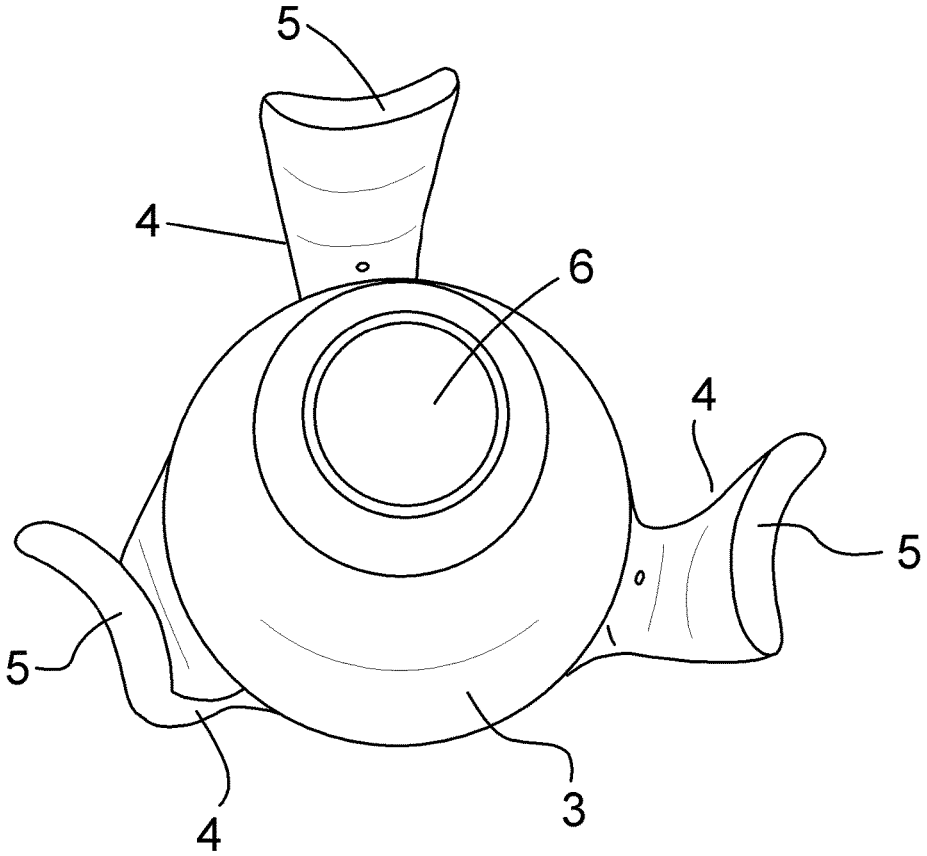
FIG. 2 shows a bottom view of the embodiment of FIG. 1.

FIG. 2 shows a bottom view of the embodiment of FIG. 1 further showing the standard cup bottom in addition to the other features.

Figure 3:
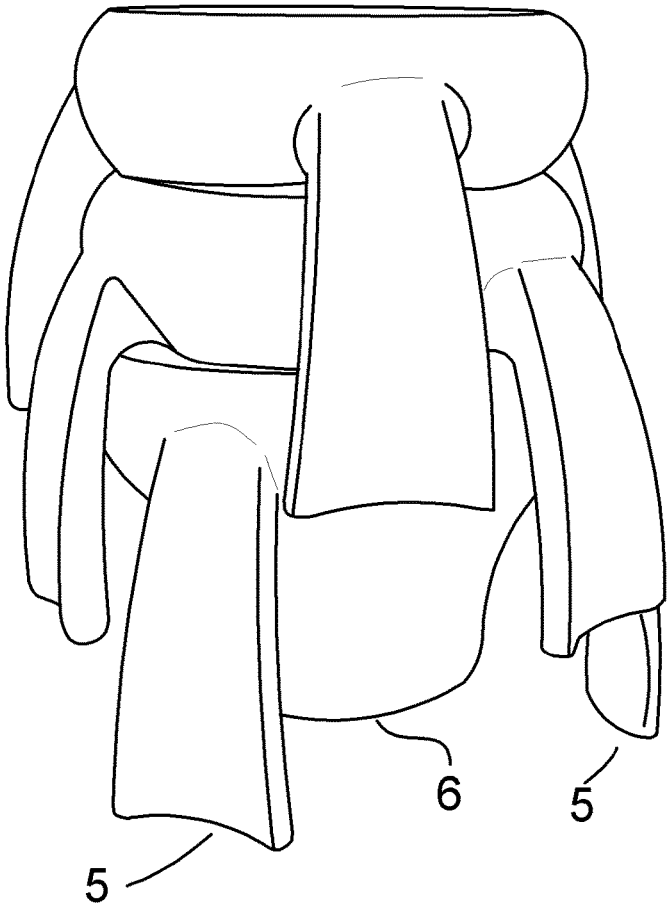
FIG. 3 shows several cups of the present invention stacked.

FIG. 3 shows how cups according to the present invention can be stacked simply by rotating the positions of the legs of each new cup as it is added to the stack.

It should be noted that the embodiment shown in FIGS. 1-3 can be made from standard material used to make cups and can be as attractive as any other cup. While coffee-cup porcelain is the preferred material for cups holding hot beverages, any other solid material such as plastic or metal may be used.

It should be appreciated that in some embodiments of the cup, the preferred material will be plastic, thereby making the cup more resistant to breaking from impact. Furthermore, when molded from plastic, the cup can be manufactured with thinner wall thickness and thus able to be stacked even more densely than if the cup is made from porcelain. Furthermore, it would be desirable in those cases that the cups can be stacked directly on top of one another without requiring they be rotated relative to one another. This becomes possible because of the thinner wall thickness.

It should also be noted that any one of the legs can be used as a handle to hold the cup.

Figure 4:
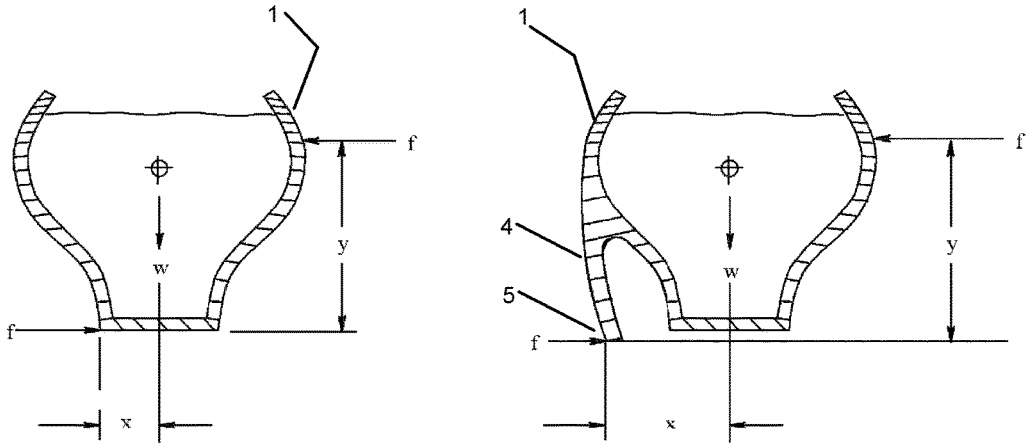
FIG. 4 shows a schematic sectional drawing of an embodiment of the present invention.

The legs function to provide a counter-torque to the moment created by a tipping force. FIG. 4 shows the relative dimensions of an embodiment of the invention. Here, it can be seen that the distance between the bottom of the legs (2 times x') is a little larger than the greatest diameter of the cup and is approximately equal to the height of the cup (y'). The left drawing in FIG. 4 shows a coffee-type cup without any legs. The frictional force is shown at the bottom of the cup, while the tipping force is shown at the top of the cup opposite the frictional force. The tipping force causes a moment (torque) that makes the cup pivot about the lower edge of the base. When the center of gravity (shown in the middle of the cup) moves past the lower edge, the cup tips over. The legs of the cup of the present invention cause the pivot point to move very far outward making it extremely difficult to move the center of gravity far enough sideways to cause tipping. In fact, on most surfaces, the cup will not tip at all, but rather slide as the translation tipping force exceeds the static frictional force.

Figure 5:
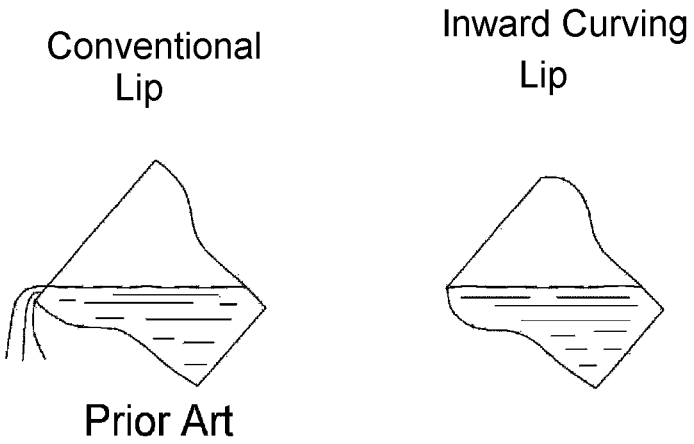
FIG. 5 shows a schematic bottom view of an embodiment of the present invention with the distance x' marked.

FIG. 5 shows a sketch of a bottom view of an embodiment of the present invention clearly showing how the distance x' is measured.

Figure 6:
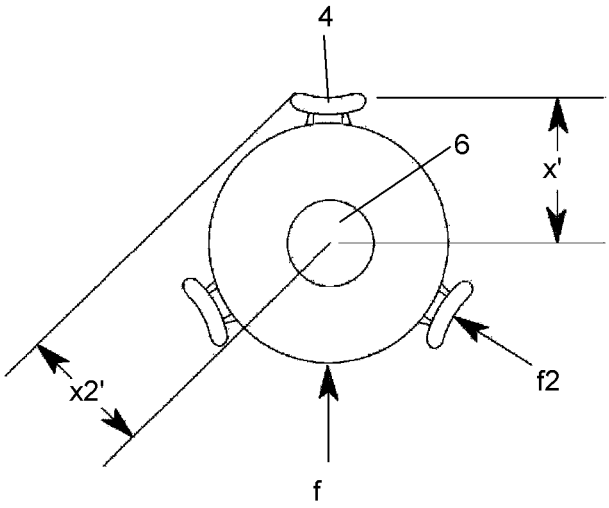
FIG. 6 shows a comparison of the curved lip of the present invention with the straight lip of a normal cup.

FIG. 6 shows the effect of the curved lip. Even if the cup is tipped at a fairly severe angle (while drinking for example), or if the cup is pushed or brushed causing sloshing of the liquid contents, the curved lip prevents liquid from escaping.

As previously stated, the preferred number of legs is three; however, the cup of the present invention may have more than three legs. It should also be noted that while the bottom of the cup body is shown as being of smaller diameter than the top of the cup body, this is not necessary to the functioning of the invention. The bottom of the cup body can have any diameter as long as it fits within the legs.

It is advantageous in some embodiments that the legs of the cup have a curved cross-section and base as shown in FIG. 1. Such curvature serves two functions, first by using such a base, the legs offer a more consistent support (x') for impacts from a variety of angular orientations about the circumference of the cup. In addition, such a curved shape matches the geometry of the fingers grasping the cup, thus providing a comfortable surface to hold the cup. It is desirable that the x' distance between the legs never varies with the angular orientation more than around 40%, so that minimum x' is no less than 0.6 of maximum x'.

In the preferred embodiment, the legs curve downward from widest point on the cup body. In this embodiment, they intersect the cup body at an acute angle and intersect the table or other resting surface at approximately a right angle. While curved legs are preferred to make them easy to hold, straight legs are within the scope of the present invention.

Several descriptions and illustrations have been provided to aid in understanding the present invention. One with skill in the art will realize that numerous changes and variations may be made without departing from the spirit of the invention. Each of these changes and variations is within the scope of the present invention.

We claim:

1. A coffee-cup system comprising:

a plurality of tip-resistant coffee cups, each cup with a drinking lip and a cup body having a lower part, an upper part and a bottom forming a cavity adapted to hold a liquid, the upper part being of greater diameter than the lower part and bottom;

each cup also having a plurality of external legs extending outward and downward from the upper part of the cup to a point below the bottom;

wherein the cups are configured to stack vertically one cup on top of another such that the bottom of one cup is inserted into the cavity of the a cup below it, and the legs of the one cup are rotated with respect to the legs of the cup below it by an angle sufficient that the legs of the one cup clear the legs of the cup below;

wherein, the legs of each cup are configured to prevent tipping by impact by having each of the legs curve continuously concave downward away from the upper part of the cup body, the continuous concave downward curve beginning from the lip of the cup and ending at the bottom of the leg;

wherein, the a region of the cup body approaching the drinking lip curves inward so that the drinking lip has a diameter smaller than the upper part of the cup body.

2. The coffee cup system of claim 1 wherein each cup has three legs.

3. The coffee cup system of claim 1 wherein each of the legs of each cup has a cross-section with an inner facing-part and an outer-facing part, the inner-facing part being convex, and the outer-facing part being concave.

4. A tip-resistant cup comprising:

a tip-resistant cup having a with a drinking lip and a cup body with a lower part, an upper part and a bottom forming a cavity adapted to hold a liquid, the upper part being of greater diameter than the lower part and bottom;

each cup also having a plurality of external legs extending outward and downward from the upper part of the cup to a point below the bottom;

wherein, the legs of each cup are configured to prevent tipping by impact by having each of the legs curve continuously concave downward away from the upper part of the cup body, the continuous concave downward curve beginning from the lip of the cup and ending at the bottom of the leg;

wherein, the a region of the cup body approaching the drinking lip curves inward so that the drinking lip has a diameter smaller than the upper part of the cup body.

5. The tip-resistant cup of claim 4 wherein the cup has three legs.

6. The tip-resistant cup of claim 5 where in the cup is a coffee cup.

7. The tip-resistant cup of claim 6 adapted so that a plurality of similar tip-resistant cups can be stacked on top of one-another with the lower part of each cup, except a lowest cup, extending into the cup body of a cup below it.

8. The tip-resistant cup of claim 4 wherein the drinking lip has a diameter larger then the lower part of said cup body.

9. The tip-resistant cup of claim 4 wherein each of the legs is wider at its distal end than at its proximal end.

10. The tip-resistant cup of claim 4 wherein each of the legs is adapted to be used as a handle.

11. The tip-resistant cup of claim 4 wherein each of the legs has a cross-section with an inner facing-part and an outer-facing part, the inner-facing part being convex, and the outer-facing part being concave.

* * * * *